United States Patent [19]

Cella

[11] 4,165,076

[45] Aug. 21, 1979

[54] GOLF PUTTER

[76] Inventor: Richard T. Cella, 160 E. 46th St., New York, N.Y. 10017

[21] Appl. No.: 766,357

[22] Filed: Feb. 7, 1977

[51] Int. Cl.[2] ..... A63B 53/04

[52] U.S. Cl. ..... 273/168; 273/129 A; 273/167 B; 273/175

[58] Field of Search ..... 273/67 R, 77 R, 79, 273/80 C, 164, 167–175, 129 R, 129 A, 83; D34/5 GC, 5 GH

[56] References Cited

U.S. PATENT DOCUMENTS

| | | | |
|---|---|---|---|
| 1,467,714 | 9/1923 | Doerr | 273/77 R X |
| 1,567,765 | 12/1925 | Spaulding | 273/83 |
| 1,589,926 | 6/1926 | Beamer | 273/167 G X |
| 2,124,534 | 7/1938 | Barnhart | 273/175 X |
| 2,472,312 | 6/1949 | Parrish | 273/175 |
| 2,472,978 | 6/1948 | Mahon | 273/168 |
| 2,826,417 | 3/1958 | Marcoccio | 273/175 X |
| 3,333,854 | 8/1967 | White | 273/168 X |
| 3,486,755 | 12/1969 | Hodge | 273/167 A X |

FOREIGN PATENT DOCUMENTS

| | | | |
|---|---|---|---|
| 14313 | of 1904 | United Kingdom | 273/175 |
| 27807 | of 1912 | United Kingdom | 273/175 |

*Primary Examiner*—Richard J. Apley

[57] ABSTRACT

An invention in sporting equipment embodied, for example, in the form of a golf club, the inventive concept being found specifically in the form of a putter. The invention is directed in particular to the putter's blade the face of which is designed to maintain the ball in balance, after it has been critically positioned before impact, while the ball is rolling torward the target hole after such impact. To this end the blade face is formed with a longitudinal edge which is the normal ball striking component of the golf club being located above the center line of the ball in blade striking position capable on proper alignment with the ball of causing the latter to roll with minimal deviation toward its target. On the reverse side of the blade there is provided a secondary ball striking edge located below the center line of the ball.

2 Claims, 4 Drawing Figures

GOLF PUTTER

This invention relates to sports equipment and, in particular, to a golf putter uniquely designed to impart a straight roll to a golf ball from a point on the ground where it had been placed in a critically balanced condition.

It is an accepted fact that nearly all golf balls are out of balance to some degree. It would seem apparent that such imbalance can be the cause of missed putts on golf course greens. Tests to determine the imbalance are carried out by floating the balls in a solution in which they will have sufficient buoyancy to float, there being a minimum of surface tension, whereby the ball will invariably turn on itself until one spot on its spherical surface is uppermost, its center of gravity being located in the lower half thereof and on that diameter of the ball which intersects the spot.

According to the present invention a golf putter is designed with a uniquely shaped blade with upper and lower edges on opposing sides thereof which are adapted to impart instant rotary motion to the ball on contact therewith. The putter shaft is attached to the blade in the vertical plane containing the ball radius projected perpendicularly to the blade. The placement of the shaft in this manner is a visual aid to the user in his effort to strike the ball without imparting undesired torque or precession thereto.

One object of the invention is to provide a new and improved golf putter designed to afford greater accuracy during play.

Other objects and advantages of the invention may be appreciated on reading the following description of one embodiment of the invention which is taken in conjunction with the accompanying drawings, in which.

Figure 1:
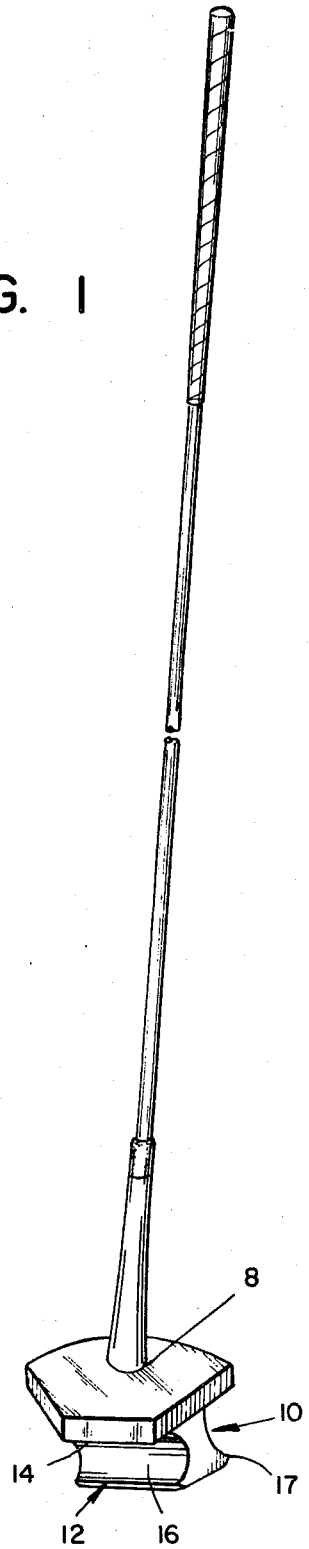
FIG. 1 is a perspective view of the golf putter.
Figure 2:
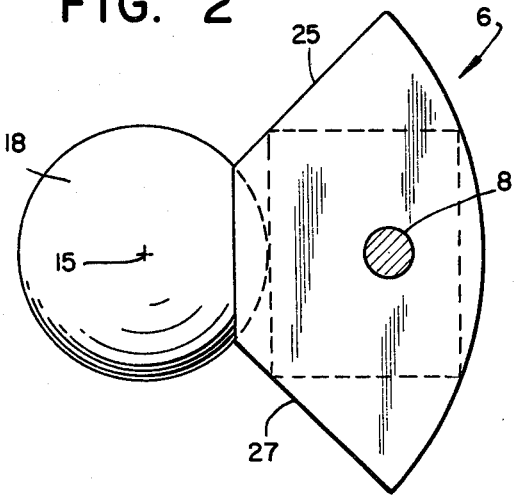
FIG. 2 is a top plan view of the putter blade.
Figure 3:
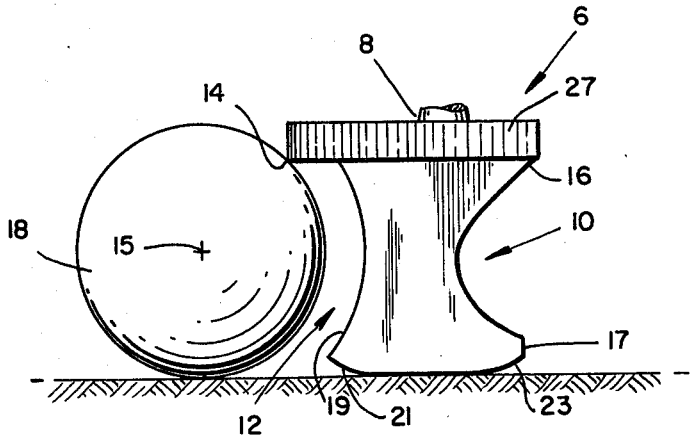
FIG. 3 is a side view of the blade.
Figure 4:
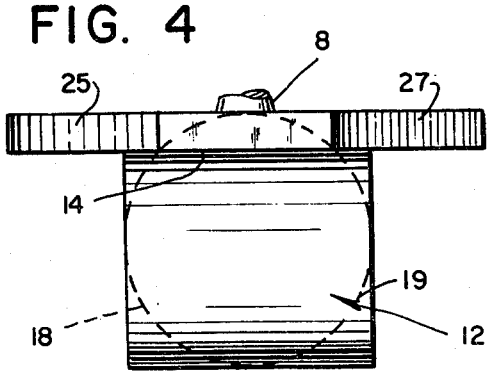
FIG. 4 is a front view of the putter blade.

Referring to the drawings, golf putter 6 is composed basically of shaft 8 and attached blade 10. The shaft is conventionally fabricated of steel or aluminum. The face 12 of the blade provides a top ball contacting longitudinal edge 14 located above the center 15 of the ball and on the reverse side 16 the blade provides a bottom ball contacting edge 17 below the center 15. The cylindrical radius of curvature 19 below the forwardly projecting edge 14 on the front face of the blade is substantially that of the spherical radius of a conventional golf ball. The edges 14 and 17 are used optionally to strike ball 18, depending on whether it is desired to impact overspin or underspin to the ball, and the bottom of the blade 10 is bevelled at 21 and 23 on the front and reverse sides, respectfully, to reduce the risk of ground scuff as the blade approaches the ball during the putting stroke. The top side edges 25 and 27 of the blade are forwardly coverging to the projection which provides the striking edge 17 thus foreshortening the latter to enhance the user's ability to properly align the putter relative to the center of the ball.

It is apparent that the improved putter can be used to impart instant rotational motion to the ball without precession or torque. Under normal conditions such rotary motion is effected after translational movement has started on blade impact ground friction causing the ball to rotate as a consequence. In this case it is only necessary to align the shaft and the top center of the ball which has been placed on the ground with its "light side" up for the reason explained hereinabove to bring about such motion instantly, the described alignment eliminating or at least reducing the effect of torque or precession normally caused by hitting the ball with its centers of mass and gravity non-coincident. The same procedure is used when the club is reversed whereby the lower edge 17 may be used as the striking component of the blade.

Various modifications of the invention may be effected by persons skilled in the art without departing from the scope and principle thereof as defined in the appended claims.

What is claimed is:

1. An instrument for imparting roll to a spherical object comprising a shaft and an object contacting blade secured to the end thereof, said blade having a front face on which there is provided a top longitudinal projection having an exposed bottom striking edge, the top side edges of the face converging respectively to the ends of said projection, the rear face of said blade having a curved surface there being provided a projection at the bottom thereof with a second striking edge.

2. An instrument as defined in claim 1 wherein the bottom of the blade is bevelled on both the front and rear sides thereof.

* * * * *